United States Patent [19]

Onoue

[11] Patent Number: 5,059,144

[45] Date of Patent: Oct. 22, 1991

[54] AHEAD/ASTERN SHIFTING DEVICE FOR MARINE PROPULSION UNIT

[75] Inventor: Akihiro Onoue, Hamamatsu, Japan

[73] Assignee: Sanshin Kogyo Kabushiki Kaisha, Hamamatsu, Japan

[21] Appl. No.: 626,373

[22] Filed: Dec. 6, 1990

Related U.S. Application Data

[63] Continuation of Ser. No. 335,804, Apr. 10, 1989, abandoned.

[30] Foreign Application Priority Data

Apr. 11, 1988 [JP] Japan ..... 63-87188

[51] Int. Cl.[5] ..... B63H 21/28

[52] U.S. Cl. ..... 440/75; 440/86; 74/378

[58] Field of Search ..... 440/75, 84, 85, 86, 440/900, 78, 87; 74/378, 480 B; 192/21, 48.1, 48.91

[56] References Cited

U.S. PATENT DOCUMENTS

| | | | |
|---|---|---|---|
| 2,696,188 | 12/1954 | Armstrong et al. | 440/86 |
| 3,874,321 | 4/1975 | Smith | 440/87 |
| 4,753,618 | 6/1988 | Entringer | 440/84 |

*Primary Examiner*—Jesus D. Sotelo

*Attorney, Agent, or Firm*—Ernest A. Beutler

[57] ABSTRACT

A shift arrangement for a marine outboard drive that permits a forward positioning of the drive shaft without interfering with the operation of the shifting mechanism.

4 Claims, 3 Drawing Sheets

AHEAD/ASTERN SHIFTING DEVICE FOR MARINE PROPULSION UNIT

This is a continuation of U.S. patent application Ser. No. 335,804, filed Apr. 10, 1989, now abandoned.

BACKGROUND OF THE INVENTION

This invention relates to a forward, reverse shifting device for a marine propulsion unit and more particularly to an improved shifting mechanism for such units.

Most well known marine outboard drives include an outer housing that is adapted to be mounted on the transom of a watercraft for steering movement about a generally vertically extending axis. Such outboard drives include a propulsion device contained within the lower unit, such as a propeller, and which is driven by a drive shaft that rotates about a generally vertically extending axis. For a wide variety of reasons, it is desirable to place the drive shaft axis as close as possible or even coincident with the steering shaft axis. By doing so, vibrations are reduced and steering is improved.

This type of drive, however, normally employs a forward, neutral, reverse transmission that consists of a driving bevel gear that is affixed to the lower end of the drive shaft and which drives a pair of counterrotating driven bevel gears that are journaled on the propeller shaft. A dog clutching sleeve, which is normally interposed between the driven bevel gears, is selectively movable to engage one or the other of the driven gears for rotation with the propeller shaft for driving it in the selected forward and reverse directions. The dog clutching sleeve is normally operated by means of some form of actuator which is in turn, controlled by a shift rod that extends vertically through the outer housing of the outboard drive unit. This shifting mechanism is normally located at the forward end of the propeller shaft and, accordingly, in order to accommodate this and also to permit it to pivot as a unit with the outboard drive when it is steered, the previous proposed constructions for effecting shifting have necessitated a rearward positioning of the drive shaft.

It is, therefore, a principal object of this invention to provide an improved shifting device for a marine propulsion unit which permits a forwardly positioned drive shaft.

It is a further object of this invention to provide an improved actuating mechanism for the shifting mechanism of a marine propulsion transmission which permits forward placement of the drive shaft without interfering with the operation of the shifting mechanism.

SUMMARY OF THE INVENTION

This invention is adapted to be embodied in a marine outboard drive that is comprised of an outer casing that is supported for steering movement about a generally vertically extending axis. A drive shaft is journaled for rotation about a generally vertically extending axis in the outer casing. Propulsion means are supported by the outer casing for propelling a watercraft to which the outboard drive is mounted. A forward, reverse transmission is positioned within the outer casing for driving the propulsion means in selected forward and reverse directions from the drive shaft. In accordance with the invention, shifting means are provided for operating the forward, reverse transmission from a position forwardly of the steering axis.

DETAILED DESCRIPTION OF THE PREFERRED EMBODIMENT

Figure 1:
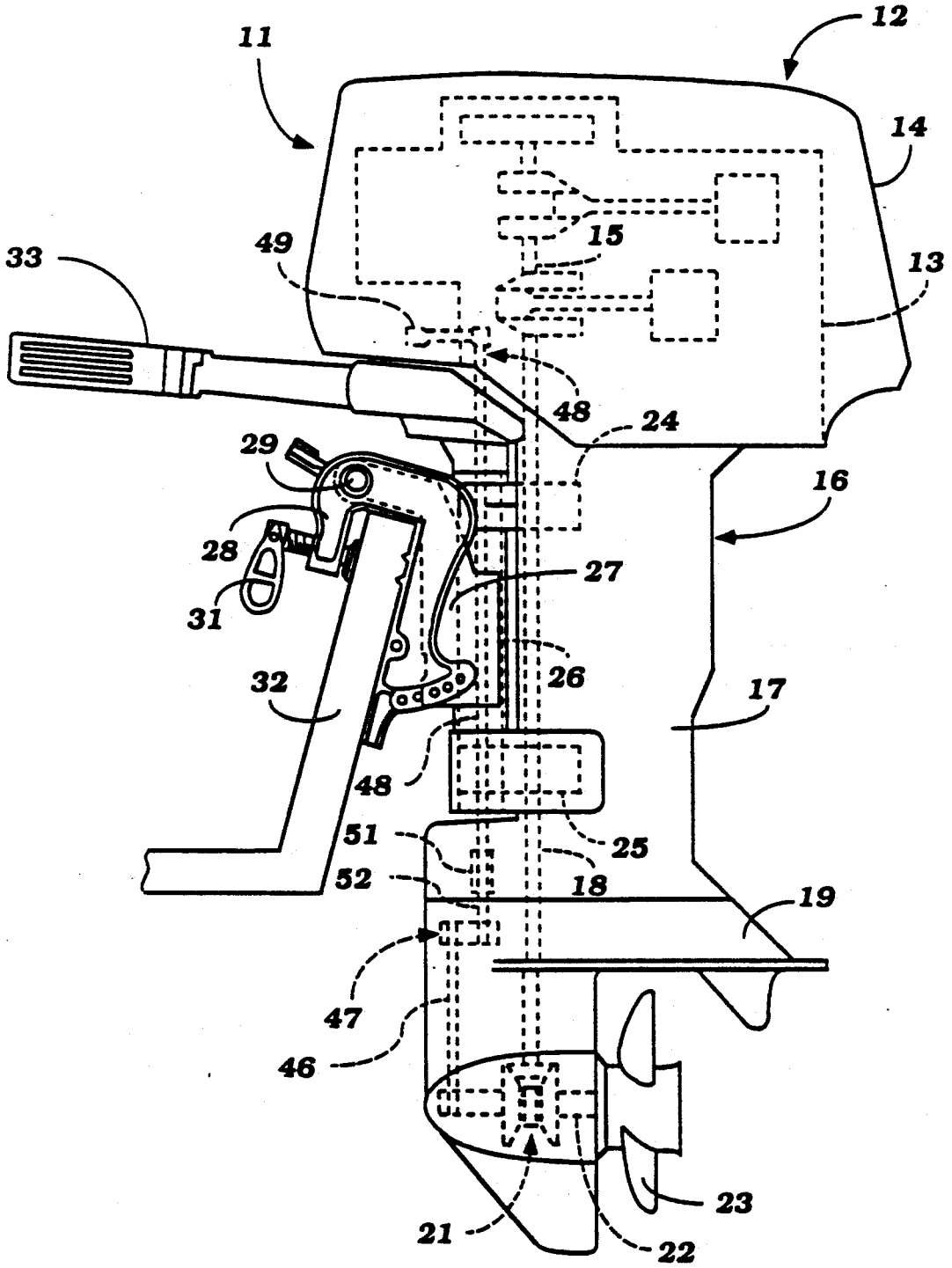
FIG. 1 is a side elevational view of an outboard motor constructed in accordance with an embodiment of the invention.

Referring first to FIG. 1, an outboard motor constructed in accordance with an embodiment of the invention is identified generally by the reference numeral 11. Although the invention is described in conjunction with an outboard motor, it is to be understood that the invention may be equally as well practiced in conjunction with an outboard drive unit of an inboard/outboard drive, such outboard units and outboard motors being hereinafter referred to generically as outboard drive units. However, the invention has particular utility in connection with an outboard motor, for reasons which will become apparent.

The outboard motor 11 is comprised of a power head, indicated generally by the reference numeral 12, which consists of an internal combustion engine 13 and a surrounding protective cowling 14. The internal combustion engine 13 may be of any known type but is depicted as being of the two cylinder inline type. As is conventional with outboard motor practice, the engine 13 is positioned with its output shaft 15 (a crankshaft in the illustrated embodiment) rotating about a generally vertically extending axis.

A drive shaft housing 16 depends from the power head 12 and includes an outer housing 17 in which a drive shaft 18 is supported for rotation about a vertically extending axis. The drive shaft 18 is coupled to the engine output shaft 15 in any suitable manner.

A lower unit 19 depends from the drive shaft housing 16 and contains a forward, neutral, reverse transmission, indicated generally by the reference numeral 21, for driving a propeller shaft 22 and propeller 23 in selected forward or reverse directions.

A pair of supporting members 24 and 25 are affixed to the drive shaft housing outer casing 17 and are affixed to a steering shaft 26 that is journaled for steering movement within a swivel bracket 27 in a known manner. The swivel bracket 27 is, in turn, pivotally connected to a clamping bracket 28 by means of a pivot pin 29 so as to accommodate tilt and trim movement of the outboard motor 11, as is well known in this art. A clamping device 31 is carried by the clamping bracket 28 for affixing the outboard motor 11 to a transom 32 of an associated watercraft, which is shown only partially. A steering tiller 33 is affixed to the upper end of the steering shaft 26 for steering of the outboard motor.

Figure 2:
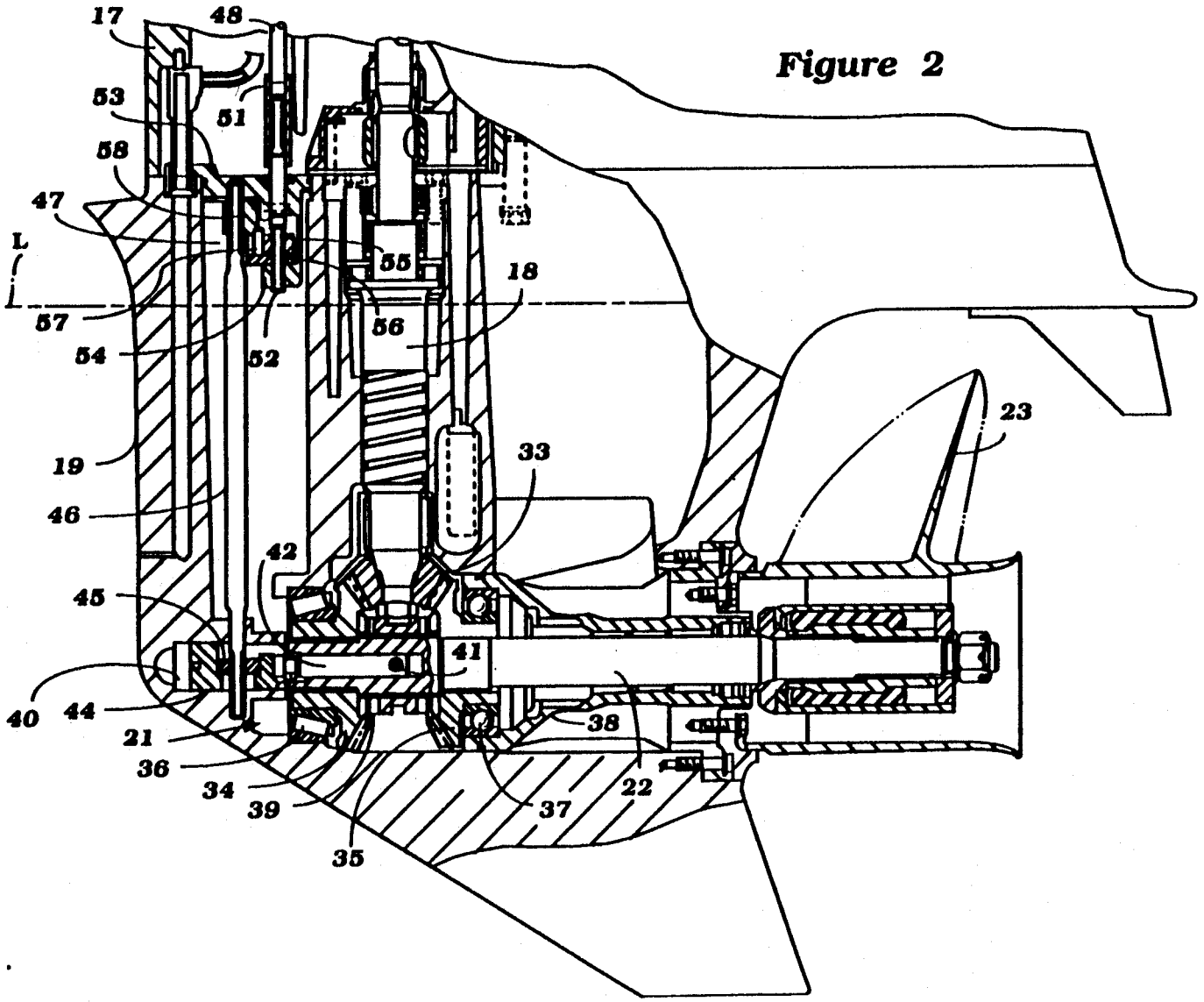
FIG. 2 is an enlarged side elevational view, with portions broken away, showing the lower unit, transmission and shifting device.

Referring now in detail to FIG. 2, the forward neutral transmission 21 is comprised of a driving bevel gear 33 that is affixed in a suitable manner for rotation with the lower end of the drive shaft 18. The driving bevel gear 33 drives a pair of counterrotating driven bevel gears 34 and 35 that are disposed on diametrically opposite sides of the driving bevel gear 33. The driven bevel gears 34 and 35 are journaled on the propeller shaft 22 and, in fact, rotatably support it by means of a thrust bearing 36 that supports the forward hub of the driven bevel gear 34 and an anti-friction bearing 37 that supports the rear hub of the driven bevel gear 35. The anti-friction bearing 37 is supported within a bearing carrier 38 that is affixed to the lower unit housing 19 in a suitable manner.

A dog clutching sleeve 39 is slidably supported by means of a splined connection on the propeller shaft 22 between the driven bevel gears 34 and 35. The dog clutching sleeve 39 has oppositely facing dog clutching teeth that are adapted to engage complementary dog clutching teeth on the driven gears 34 or 35 so as to drivably couple these gears with the propeller shaft 22 for driving the propeller 23 in selected forward or reverse directions. The dog clutching sleeve 39 is also positionable in a neutral position as shown in FIG. 2, wherein neither of the gears 34 or 35 are drivingly coupled to the propeller shaft 22 so that the propeller shaft 22 will idle relative to the drive shaft 18.

The dog clutching sleeve 39 is connected by means of a cross pin 41 to a slidably supported shift plunger 42 that is supported within a bore at the forward end of the propeller shaft 22. The plunger 42 has a headed portion 43 (FIG. 3) that is received within a shift actuator 44 that is slidably supported in a bore 40 formed at the forward end of the lower unit casing 19. The shift actuator 44 has a cam shape recess in which a cam actuator 45 is supported. The cam actuator 45 is affixed to the lower end of a lower shift rod 46. Rotation of the lower shift rod 46 will effect rotation of the cam actuator 45 and reciprocation of the plunger 42 and axial movement of the dog clutching sleeve 39 to effect shifting in forward or reverse directions.

It should be noted that the forward positioning of the shift rod 46 relative to the drive shaft 18 means that the drive shaft 18 must, in conventional arrangements, be positioned fairly rearwardly of the steering shaft 26. The reason for this is that it is desirable that the shift rod 46 be pivotal with the outboard motor 12 so that steering movement of the outboard motor 12 does not effect operation of the shifting mechanism. However, as has been previously noted, it is desirable to maintain the axis of rotation of the drive shaft 18 as close to the axis of steering as possible and the forward placement of the shift rod 46 in conventional constructions has made this difficult.

Figure 3:
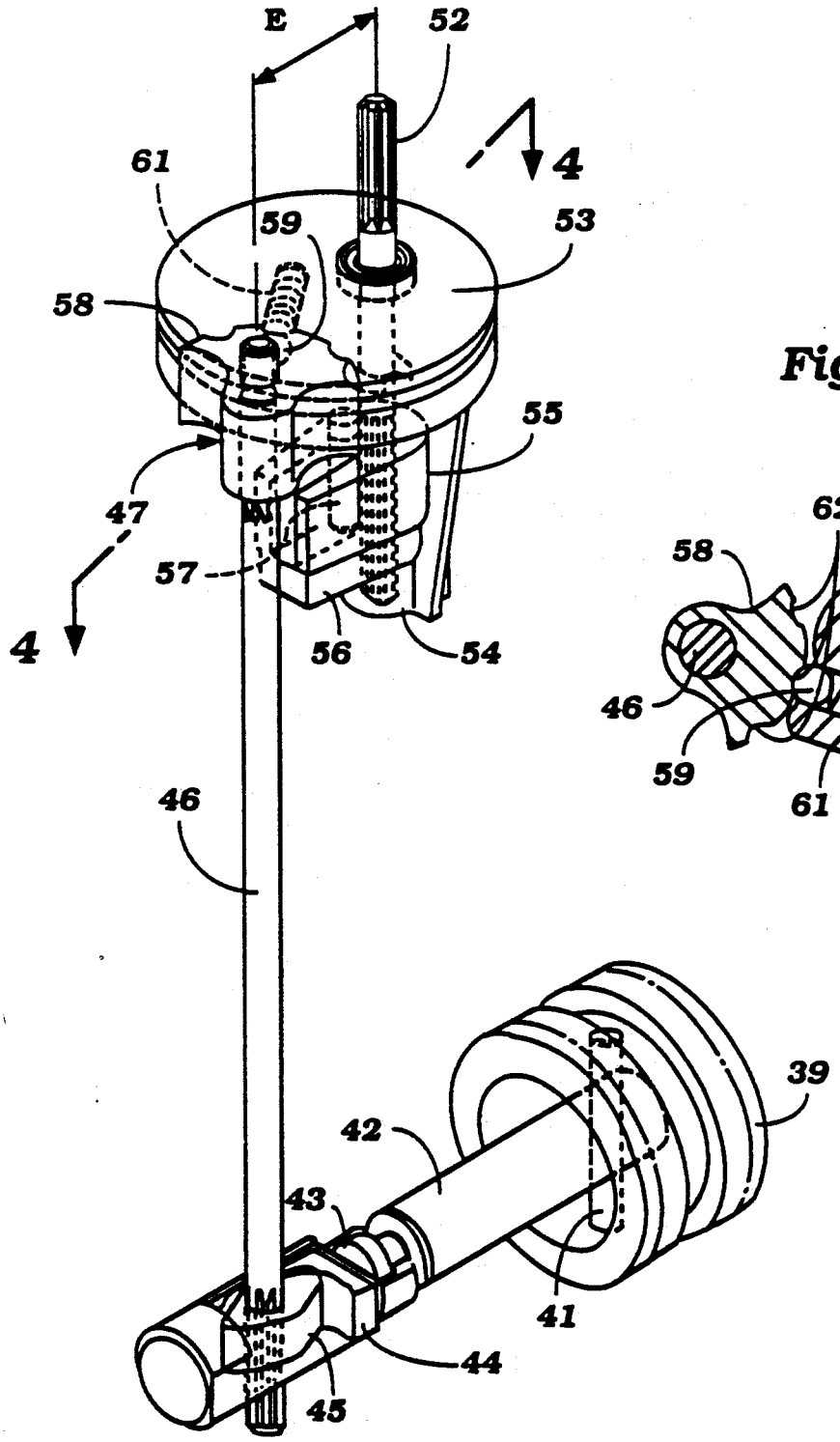
FIG. 3 is a perspective view of the shifting mechanism for the transmission.
Figure 4:
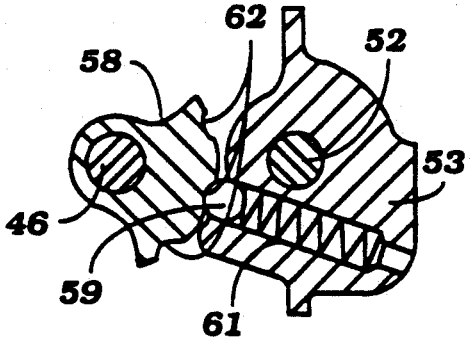
FIG. 4 is a cross-sectional view taken along the line 4—4 and shows the detent mechanism for the shifting mechanism.

In accordance with the invention there is provided a shift actuating mechanism, indicated generally by the reference numeral 47 that is operative to transmit motion to the lower shift rod 46 from an upper shift control rod 48 that is positioned rearwardly of the lower shift rod 46 and which is connected to a shift lever 49 (FIG. 1) at its upper end so as to achieve shifting operation Referring primarily to FIGS. 2 through 4, the lower end of the upper shift control rod 48 has a splined connection to a coupling 51 which, in turn, couples the upper shift control rod 48 to an intermediate shift rod 52. The intermediate shift rod 52 is journaled within a closure plate 53 that is affixed to the upper end of the lower unit housing 19 at its interface with the drive shaft housing 17. It should be noted that this position is above the normal water level L so that the motion transmitting mechanism 47, which can have substantial width, is positioned above the normal water line and thus will not offer any significant flow restriction, particularly under high speed travel.

As may be best seen in FIGS. 2 and 3, the closure plate 53 has a lower bearing portion 54 which also serves to journal the intermediate shift rod 52. A shift yoke 55 having a forwardly facing slotted opening is affixed to the portion of the intermediate shift rod 52 between the main portion of the closure plate 53 and the bearing portion 54. A bottom plate 56 closes the lower end of this slot and the bottom plate 56 is affixed in a suitable manner to the yoke 55.

A pin 57 depends into the slot defined by the yoke 55 and is affixed to a cam lever 58 which is, in turn, affixed to the shift rod 46. As a result, rotation of the intermediate shift rod 52 will effect rotation of the lower shift rod 46 due to the pin and slot connection just described.

It will be noted that the offset between the lower shift rod 46 and the upper shift control rod 48 and intermediate shift rod 52 is by the distance E which permits the drive shaft 18 to be, in effect, moved this distance closer to the axis of the steering shaft 26 than with previously proposed constructions.

A detent mechanism comprised of a detent ball 59 that is slidably supported within a bore of the closure plate 53 and which is urged by a detent spring 61 into engagement with respective recesses 62 formed in the lever 58 serve to releasably restrain the shift mechanism in the neutral, forward and reverse positions.

It should be readily apparent from the foregoing description that the described construction permits the shift mechanism to be located so that it can readily be operated and, at the same time, does not interfere with a forward placement of the drive shaft for the outboard drive. Although an embodiment of the invention has been illustrated and described, various changes and modifications may be made without departing from the spirit and scope of the invention, as defined by the appended claims.

I claim:

1. In a marine outboard drive comprising an outer casing supported for steering movement about a generally vertically extending steering axis, a drive shaft journaled for rotation about a generally vertically extending axis in said outer casing and spaced from said steering axis, propulsion means supported by the said outer casing for propelling a watercraft to which said outboard drive is mounted, a forward, reverse transmission positioned within a lower unit of said outer casing including a dog clutching element for driving said propulsion means in selected forward and reverse directions from said drive shaft, the improvement comprising shifting means comprising a rotatably journaled lower shift rod for operating said dog clutching element of said forward, reverse transmission upon rotation about an axis disposed forwardly of said steering axis, an upper shift rod journaled about an axis coincident with said steering axis, a pin and a slot, cam and follower arrangement for rotating said lower shift rod upon rotation of said upper shift rod for reciprocating said dog clutching element between its positions, and detent means cooperating with said lower shift rod contiguous to said cam and follower arrangement releasably locking said lower shift rod in tis forward, neutral and reverse position.

2. In a marine outboard drive as set forth in claim 1 further including a shift lever supported at the upper end of the outboard drive and connected to the upper shift rod.

3. In a marine outboard drive as set forth in claim 1 wherein the outer casing comprises a driveshaft housing journaling the driveshaft and a lower unit affixed to the lower end of said drive shaft housing and containing said forward reverse transmission, said cam and follower arrangement and said detent means being positioned contiguous to the interface between said drive shaft housing and said lower unit housing of said outer casing.

4. In a marine outboard drive as set forth in claim 3 wherein the marine outboard drive comprises an outboard motor having a power head containing an internal combustion engine affixed to the upper end of the outer casing and driving the driveshaft.

* * * * *